United States Patent [19]

Stearns

[11] 4,090,444

[45] May 23, 1978

[54] PRINTING BLANKET HOLDING BAR

[75] Inventor: Joseph E. Stearns, Dayton, Ohio

[73] Assignee: Dayco Corporation, Dayton, Ohio

[21] Appl. No.: 778,298

[22] Filed: Mar. 16, 1977

[51] Int. Cl.[2] ..... B41F 27/06

[52] U.S. Cl. ..... 101/415.1; 24/81 B; 101/378

[58] Field of Search ..... 24/81 B; 269/239, 97; 101/415.1, 378, 382 R-386, 127.1, 128.1, 394

[56] References Cited

U.S. PATENT DOCUMENTS

| | | | |
|---|---|---|---|
| 1,578,736 | 3/1926 | John | 101/415.1 |
| 2,898,648 | 8/1959 | Bright | 24/81 B |
| 2,997,763 | 8/1961 | Serfass | 24/81 B |
| 3,144,733 | 8/1964 | Balinski | 24/81 B |
| 3,154,012 | 10/1964 | Fischer | 101/415.1 |
| 3,296,673 | 1/1967 | Kirkpatrick | 101/415.1 |
| 3,410,211 | 11/1968 | Grünig | 101/415.1 |
| 3,489,085 | 1/1970 | Kirkpatrick | 101/415.1 |
| 3,584,580 | 6/1971 | Schultz | 101/415.1 |
| 3,885,486 | 5/1975 | Kirkpatrick et al. | 83/659 |
| 3,896,727 | 7/1975 | Ruckdeschel, Jr. | 101/415.1 |

FOREIGN PATENT DOCUMENTS

| | | | |
|---|---|---|---|
| 313,175 | 7/1919 | Germany | 101/415.1 |
| 918,276 | 2/1963 | United Kingdom | 101/415.1 |

*Primary Examiner*—William Pieprz
*Attorney, Agent, or Firm*—Reuben Wolk

[57] ABSTRACT

A printing blanket holding bar and printing blanket assembly using same are provided wherein said holding bar comprises a substantially U-shaped member having a bight and a pair of legs extending from opposite ends of the bight and a blanket clamping arm carried by the bight with the arm being adapted to cooperate with the bight to fix an associated end portion of a printing blanket therebetween with the legs being adapted to quickly attach and detach the holding bar relative to a bar support.

17 Claims, 3 Drawing Figures

PRINTING BLANKET HOLDING BAR

BACKGROUND OF THE INVENTION

In lithographic printing it is common practice to employ printing blankets each fastened around the periphery of an associated printing cylinder and for the purpose of picking up an ink design or image deposited thereon by an inking roller or master for transfer to an article being printed. It is common practice to fasten a printing blanket on an associated cylinder by fastening each of its opposite end portions to an associated so-called holding bar and each holding bar is then detachably mounted on such cylinder. In many application the printing cylinder employs so-called reel rods or reels associated therewith and each reel has a bar support for quickly attaching and detaching the holding bar relative thereto and various techniques and apparatus have been proposed heretofore for providing such attachment and detachment of the holding bar relative to its bar support on a reel, for example. However, because of the importance of operating printing presses with minimum operating delays it is desirable to provide means for quickly attaching and detaching printing blanket holding bars of the character mentioned on printing cylinders so as to assure operation of an associated printing press with minimum down time.

SUMMARY

It is a feature of this invention to provide a simple and economical printing blanket holding bar which is easily and quickly attached and detached relative to a bar support provided on an associated printing cylinder of a printing press.

Another feature of this invention is to provide printing blanket assembly employing a holding bar of the character mentioned.

Another feature of this invention is to provide a printing blanket holding bar of the character mentioned particularly adapted to be readily used with a so-called reel rod or reel provided on printing cylinders.

Another feature of this invention is to provide a printing blanket holding bar and printing blanket assembly using same wherein the holding bar comprises a substantially U-shaped member having a bight and a pair of legs extending from opposite ends of the bight and a blanket clamping arm carried by the bight with the arm being adapted to cooperate with the bight to fix an associated end portion of a printing blanket therebetween with the legs being adapted to quickly attach and detach the holding bar relative to a bar support.

Another feature of this invention is to provide a printing blanket holding bar and printing blanket assembly employing such a holding bar having one or more of the novel features set forth above or hereinafter shown or described.

Other details, features, objects, uses, and advantages of this invention will become apparent from the embodiments thereof presented in the accompanying specifications, claims, and drawings.

BRIEF DESCRIPTION OF THE DRAWING

The accompanying drawing shows present preferred embodiments of this invention, in which.

DESCRIPTION OF ILLUSTRATED EMBODIMENTS

Figure 1:
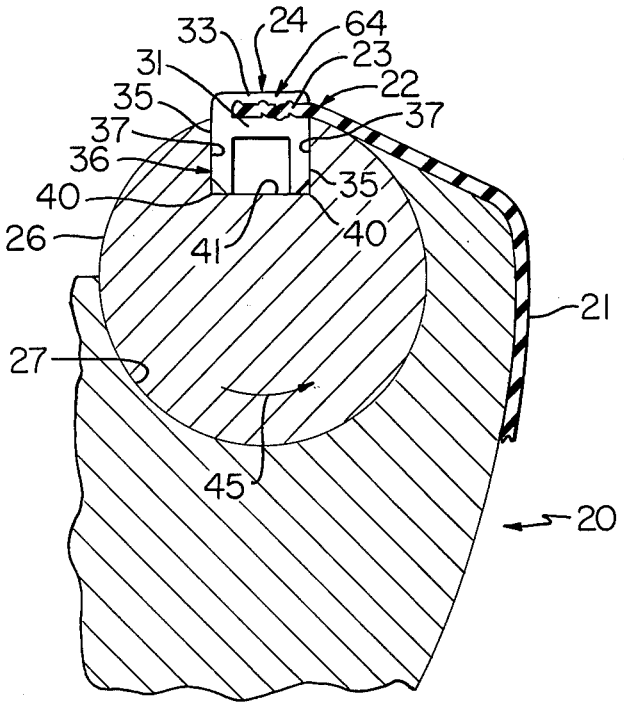
FIG. 1 is a fragmentary cross-sectional end view of a portion of a printing cylinder employing one exemplary embodiment of a reel rod or reel thereof and showing a trailing end portion of a printing blanket assembly held in position on such reel.

Reference is now made to FIG. 1 of the drawing which illustrates a fragmentary portion of an exemplary printing cylinder of the type commonly employed in a printing press used in lithographic printing and such cylinder is designated generally by the reference numeral 20. The cylinder 20 has a printing blanket assembly 21 suitably disposed therearound and held substantially tautly in position utilizing techniques which are well known in the art and in particular the blanket has a leading end portion (not shown) which is suitably detachably fastened to the cylinder 20 and a trailing end portion 22 including a terminal end portion 23 which is fixed to the holding bar 24 of this invention and such holding bar will be described in detail subsequently.

The printing cylinder 20 has a so-called reel rod which will be referred to hereinafter as a reel 26 which is supported for rotation within a substantially cylindrical recess 27 of the cylinder 20 and in a manner which is well known in the art. The construction and arrangement of the holding bar 24 is such that it may be readily operatively installed on and removed from, i.e., attached to and detached from, the reel 26 with minimum down time for the press employing the printing cylinder 20.

For ease of presentation only a fragmentary part of the printing cylinder 20 is illustrated and such part is operatively associated with the reel 26 used to fasten or attach the terminal end portion 22 of the blanket assembly in position. It will be appreciated that the previously mentioned leading end portion of the blanket 21 may be attached in position employing conventional means or in case of cylinders having so-called double reel rods or reels such leading end portion is attached in position in a similar manner as employed for the trailing end portion.

Figure 3:
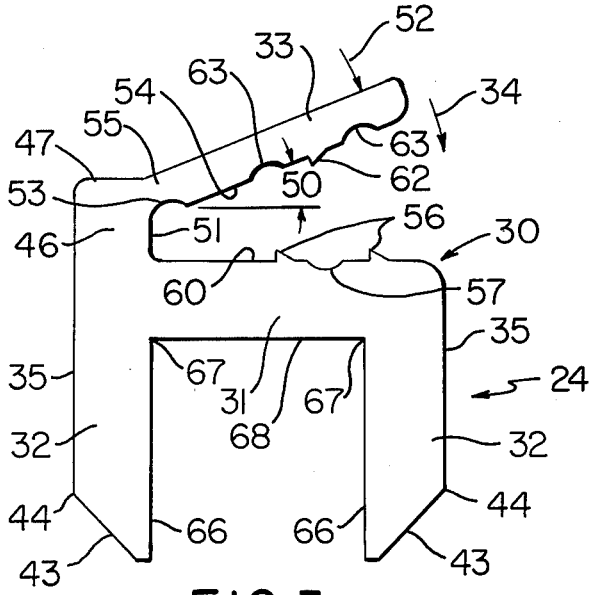
FIG. 3 is an end view of the holding bar of this invention.

Reference is now made to FIG. 3 of the drawing which shows the printing blanket holding bar 24 in enlarged end view prior to installation of the terminal end portion 23 of the printing blanket 21 therewithin. The holding bar 24 comprises a substantially U-shaped member designated generally by the reference numeral 30 having a bight 31 and a pair of legs, each designated by the same reference numeral 32, extending from opposite ends of the bight 31 with the legs 32 extending perpendicularly from the bight 31 and thus being in parallel relation and such legs will be described in more detail subsequently.

The holding bar 24 also has a blanket clamping arm 33 which is carried by the bight 31 and arm 33 is particularly adapted to cooperate with such bight 31 to fix an associated end portion, such as the terminal end portion 23 of the blanket 21, therebetween. In FIG. 3 the arm is shown in what will be referred to as a raised or unclamped position, prior to being forced in clamping engagement against end portion 23 of the blanket 21, and this facilitates placement of the end portion 23 between such bight 31 and arm 33. The construction of the arm 33 is such that it is substantially permanently repositioned or formed toward the bight 31, as indicated by the arrow 34, so that it is disposed substantially parallel to bight 31 thereby clamping the end portion 23 of the blanket 21 between the bight 31 and arm 33.

The holding bar 24 is unique in that it has legs 32 which are of simple and unique construction and enables such holding bar to be quickly and easily attached and detached relative to a bar support comprising the reel 26 and in a manner which will be described in more detail subsequently.

The legs 32 of the holding bar 24 have outside surfaces 35 which face away from each other, i.e., face in diametrically opposite directions, and the surfaces 35 are adapted to be disposed against and within cooperating surfaces of a bar support for such holding bar 24. In particular, in this exemplary illustration of FIG. 1, the reel 26 has a cutout of roughly rectangular outline defined therein and such channel is designated by the reference numeral 36. The channel 36 is defined by a pair of cooperating parallel planar surfaces 37 having lower innermost edges 40 connected by a planar surface 41 disposed therebetween perpendicular to the surfaces 37.

The reel 26 serves as a bar support for the holding bar 24 and the surfaces 37 serve as cooperating surfaces against and within which the outside surfaces 35 of the holding bar 24 are disposed to thereby readily attach and detach the holding bar relative to the reel 26. The planar outside surfaces 35 of the legs 32 have a pair of inclined surfaces 43 adjoining the outer edges 44, i.e., outer edges 44 being remote from the bight 31, of the surfaces 35 and the inclined surfaces 43 serve as guide or cam surfaces enabling quick and easy installation of the holding bar 24 within the channel 36 and thus positioning surfaces 35 against cooperating surfaces 37.

The fit between the surfaces 35 and 37 is sufficiently close that once the reel 26 is wound in the usual manner, and as illustrated by the arrow 45, the frictional force between surfaces 35 and 37 holds the bar 24 in position against movement radially outwardly from the center of the reel 26 and while enabling the application of a tensioning force against the blanket 21 in the usual manner.

The bight 31 of the U-shaped portion of the holding bar 24 has an extension 46 extending substantially diametrically opposite from one of its legs 32 shown as the left leg as pictured in FIG. 3, and it will be seen that the clamping arm 33 extends from the outer portion 47 of the extension 46. Further, it will be seen that the U-shaped member 30 with its bight 31, legs 32, extension 46, and arm 33 are preferably defined as a single piece construction. Further, although any suitable material employed in the art for the purpose of making holding bars may be used to make the holding bar 24 it will be appreciated that the holding bar 24 is preferably made as an extruded single piece part from a metallic material that is easily extruded.

The arm 33 is preferably defined as a part of a single piece extrusion so that it is disposed at an inclined angle, indicated at 50, with the bight 31. This angular disposition of arm 33 enables easy installation of the associated end portion of the blanket 21 therewithin so that the end portion of the blanket is disposed substantially against inside surface 51 of the extension 46 and once this has been achieved the arm 33 is permanently formed or restructured to change the basic disposal thereof so that it is disposed substantially parallel to bight 31 and as illustrated in FIG. 1.

The arm 33 is permanently formed by applying forces thereagainst essentially as indicated by a typical force arrow 52 and utilizing any suitable equipment employed in the art for this purpose, such as a press. The inner end portion of the arm 33 has a rounded surface 53 interconnecting surface 51 and the main part of the inside surface 54 of such arm so that the arm may be formed parallel to the bight 31 without creating substantial internal stresses in such arm 33 in the area indicated at 55 where the arm 33 adjoins the extension 46.

The bight 31 also has at least one tooth-like projection extending therefrom toward arm 33 and in this disclosure of the invention such bight has a plurality of two spaced apart tooth-like projections 56 disposed along its length with a recess 57 disposed therebetween. The projections 56 and recess 57 are with reference to a surface defining what may be considered an outside surface 60 of the bight 31. It will also be seen that the arm 33 has at least one tooth-like projection 62 extending therefrom toward bight 31 and a plurality of recesses 63 extending along the length of the arm 33 with the tooth-like projection 56 and recesses 63 being provided relative to inside surface 54 of the arm 33. The teeth 56 are disposed such that with the arm 33 disposed parallel to the bight 31 the teeth 56 are arranged substantially opposite the recesses 63. Similarly, with the arm 33 parallel to the bight 31 tooth-like projection 62 is disposed substantially opposite the recess 57 in the bight 31. This arrangement assures that once the arm 33 is disposed parallel to bight 31 the end portion of the blanket 23 clamped between bight 31 and arm 33 assumes a sort of wavy or undulating configuration as illustrated at 64 in FIG. 1. The projections 56 and 62 tend to imbed themselves within the associated end portion of the blanket 21 without damaging same and each recess disposed opposite a particular tooth assures that the blanket assumes an undulating configuration defined on one side by a recess and on the other side by a tooth without piercing of such blanket thereby assuring that the blanket is held firmly in position in the holding bar 24.

The holding bar 24 is of optimum versatility in that it has planar outside surfaces 35 on its legs 32 which are particularly adapted to engage cooperating surfaces 37 in the reel 26 of cylinder 20. However, the holding bar 24 has planar inside surfaces 66 defining the inside surfaces of the legs 32 of its U-shaped portion 30 and the legs in the inside surfaces having inner edges 67 which are connected by a planar surface 68 which is disposed substantially parallel to the surface 60 of the bight 31. The inside surfaces 66 face toward each other and are particularly adapted to be disposed in clamping relation around and against cooperating surfaces of a bar support which will be described in detail subsequently.

The holding bar 24 may be held in position employing outer or outside surfaces 35, as described above, or inside surfaces 66. The manner in which the inside surfaces 66 are employed will now be described in detail.

Figure 2:
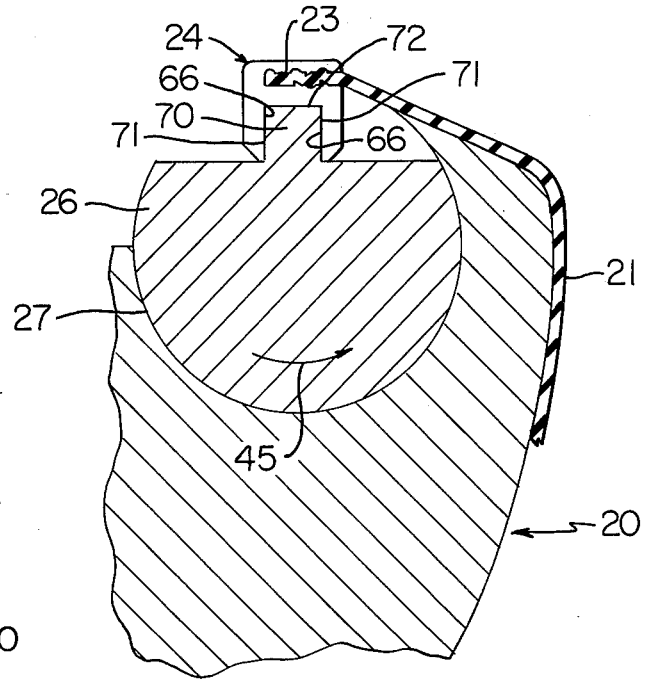
FIG. 2 is a view similar to FIG. 1 showing another exemplary embodiment of a reel on the cylinder of FIG. 1 with a trailing end portion of a printing blanket assembly held in position on such reel.

Reference is now made to FIG. 2 of the drawing which illustrates the printing cylinder 20 modified to employ a reel rod or reel which is also designated by the reference numeral 26 and which is supported for rotation within a cylindrical recess 27 of the cylinder 20. The main difference between the reel 26 in FIG. 1 and the reel 26 of FIG. 2 is that the reel of FIG. 2 has a projection 70 thereon, instead of having a channel 37 therein.

The projection 70 of reel 26 is of substantially rectangular outline and is defined by a pair of parallel outside surfaces 71 interconnected at their outer edges by planar surface 72. The support for the holding bar 24 is defined by projection 70 and its surfaces 71.

The holding bar 24 is shown on the reel 26 of FIG. 2 with the surfaces 66 disposed around and against the cooperating surfaces 71 while providing a snug fit therebetween; and, upon rotating the reel 26 as indicated by arrow 45 in the manner known in the art frictional engagement between surfaces 71 and 66 is such that the holding bar 24 is held firmly in position on the projection 70 and is prevented from moving radially outwardly regardless of the rotary position of the cylinder 20.

In this disclosure of the invention the bar support or support for holding bar 24 is defined as an integral part of an associated reel 26 whether it be the reel 26 of FIG. 1 or of FIG. 2. However, it will be appreciated that the bar support may be in the form of a separate member or component fixed to reel 26, for example.

The surfaces 37 and 41 defining the channel 36 in the reel 26 of FIG. 1 are shown as an integral part of the reel 26; however, such surfaces may be defined as similar functioning surfaces of an inexpensive U-shaped insert which may be readily fixed in position and removed from its reel. With such a U-shaped insert wear of the surfaces corresponding to surfaces 37 merely requires replacement of the inserts. Similarly, it will be appreciated that the projection 70 instead of being defined as an integral part of a reel 26 in FIG. 2 may be in the form of a rectangular member suitably fixed to a reel 26.

Thus, it will be seen that the holding bar 24 of this invention has optimum versatility in that it may be readily attached and detached relative to a holding bar support regardless of whether such holding bar support is defined as a part of a single piece reel or is in the form of a separate member fixed to an associated reel. Further, the holding bar 24 has optimum versatility in that it has two sets or two pairs of surfaces each pair of which may be employed to attach and detach the holding bar relative to a bar support.

The printing blanket 21 has been illustrated by cross hatching in the drawing of this disclosure as being made of rubber; however, it will be appreciated that the blanket of this invention may be made utilizing any suitable material known in the art. Further, such printing blanket may be reinforced utilizing any suitable reinforcing material or technique known in the art.

It should also be emphasized that the construction of the holding bar of this invention is such that it may be attached to a bar support without requiring additional members or locks to hold the bar in position. In essence, the attachment is achieved solely by utilizing the unique and simple design of the holding bar with its sets of surfaces 35—35 and 66—66 and the normal function of the reel of a printing cylinder.

It should be understood that the close contact between the reel 26 and the recess 27 of the cylinder 20, illustrated in FIGS. 1 and 2, is merely one example of an assembly in which the blanket 21 is comparatively short; i.e., about 26 inches. However, where longer blankets are used, such as 60 inches or so, the reel 26 is spaced sufficiently far from recess 27 to permit the blanket to be wrapped around the reel in a plurality of layers.

While present exemplary embodiments of this invention, and methods of practicing the same, have been illustrated and described, it will be recognized that this invention may be otherwise variously embodied and practiced within the scope of the following claims.

What is claimed is:

1. A printing blanket holding bar comprising a substantially U-shaped member having a bight and a pair of legs extending from opposite ends of said bight, and a blanket clamping arm being adapted to cooperate with said bight to fix an associated end portion of a printing blanket therebetween, said legs having cooperating planar surfaces which are adapted to engage cooperating surfaces of a bar support to quickly attack and detach said holding bar relative to said bar support, said cooperating planar surfaces comprising a pair of planar inside surfaces which face toward each other and a pair of planar outside surfaces which face away from each other, each of said pair of surfaces being adapted to be selectively employed and brought into engagement with said cooperating surfaces of said bar support to enable attachment and detachment of said holding bar relative thereto, each of said pair of surfaces when selectively employed defining the sole means for holding said bar on said bar support.

2. A holding bar as set forth in claim 1 in which said inside surfaces are adapted to be disposed in clamping relation around said cooperating surfaces of said bar support.

3. A holding bar as set forth in claim 1 in which said outside surfaces are adapted to be disposed within said cooperating surfaces of said bar support.

4. A holding bar as set forth in claim 1 in which said cooperating planar surfaces are disposed perpendicularly to said bight.

5. A holding bar as set forth in claim 1 in which said planar inside surfaces are disposed in parallel relation and said planar outside surfaces are also disposed in parallel relation and parallel to said planar inside surfaces.

6. A holding bar as set forth in claim 4 in which said pair of planar outside surfaces have a pair of inclined surfaces adjoining their outer edges said inclined surfaces being particularly adapted to enable disposal of said outside surfaces within said cooperating surfaces.

7. A holding bar as set forth in claim 1 in which said bight has an integral extension extending therefrom in a direction substantially diametrically opposite from one of said legs of said U-shaped member and said clamping arm extends from said extrusion.

8. A holding bar as set forth in claim 7 in which said U-shaped member with its bight and parallel legs and said extension and arm are defined as a single-piece construction.

9. A holding bar as set forth in claim 8 in which said arm has at least one tooth-like projection extending therefrom which is adapted to engage said blanket and help hold same within said holding bar.

10. A holding bar as set forth in claim 9 in which said bight has at least one tooth-like projection extending therefrom which is adapted to engage said blanket and help hold same within said holding bar.

11. A holding bar as set forth in claim 8 in which said single-piece construction is an extruded member.

12. A holding bar as set forth in claim 11 in which said extruded member is a metal member.

13. A printing blanket assembly comprising a printing blanket and at least one printing blanket holding bar fixed to said blanket, said holding bar comprising, a substantially U-shaped member having a bight and a pair of legs extending from opposite ends of said bight, and a blanket clamping arm carried by said bight substantially parallel thereto, said arm being adapted to cooperate with said bight to fix an associated end portion of said printing blanket therebetween, said legs having cooperating planar surfaces which are adapted to engage cooperating surfaces of a bar support to quickly attach and detach said holding bar relative to said support, said cooperating planar surfaces comprising a pair of planar inside surfaces which face toward each other and a pair of planar outside surfaces which face away from each other, each of said pair of surfaces being adapted to be selectively employed and brought into engagement with said cooperating surfaces of said bar support to enable attachment and detachment thereto, each of said pair of surfaces when selectively employed defining the sole means for holding said bar on said bar support.

14. An assembly as set forth in claim 13 in which said inside surfaces are adapted to be disposed in clamping relation around said cooperating surfaces of said bar support.

15. An assembly as set forth in claim 13 in which said outside surfaces are adapted to be disposed within said cooperating surfaces of said bar support.

16. An assembly as set forth in claim 13 in which said bight of said holding bar has an integral extension extending therefrom in a direction substantially diametrically opposite from one of said legs of said U-shaped member and said clamping arm extends from said extension.

17. An assembly as set forth in claim 16 in which said U-shaped member with its bight and parallel legs and said extension and arm are defined as a single-piece construction.

* * * * *